United States Patent [19]

Boardman et al.

[11] Patent Number: 4,905,757

[45] Date of Patent: Mar. 6, 1990

[54] COMPACT INTERMEDIATE HEAT TRANSPORT SYSTEM FOR SODIUM COOLED REACTOR

[75] Inventors: Charles E. Boardman, Saratoga; John P. Maurer, San Jose, both of Calif.

[73] Assignee: General Electric Company, San Jose, Calif.

[21] Appl. No.: 231,031

[22] Filed: Aug. 11, 1988

Related U.S. Application Data

[63] Continuation-in-part of Ser. No. 117,609, Nov. 6, 1987, abandoned.

[51] Int. Cl.[4] ..... F28D 7/00

[52] U.S. Cl. ..... 165/160; 165/81; 165/163; 165/104.28; 376/405; 376/407

[58] Field of Search ..... 165/104.28, 104.31, 165/160, 163, 81; 122/32, 34; 376/404, 405, 406, 407; 417/50

[56] References Cited

U.S. PATENT DOCUMENTS

| | | | |
|---|---|---|---|
| 3,425,907 | 2/1969 | Bonsel et al. | 165/104.31 |
| 3,882,933 | 5/1975 | Kube | 165/163 |
| 4,056,439 | 11/1977 | Robin | 376/405 |
| 4,216,821 | 8/1980 | Robin | 376/405 |
| 4,377,552 | 3/1983 | Doublet et al. | 376/405 |
| 4,644,906 | 2/1987 | Garabedian et al. | 376/405 |
| 4,737,337 | 4/1988 | Garabedian et al. | 376/405 |

FOREIGN PATENT DOCUMENTS

| | | |
|---|---|---|
| 0200989 | 11/1986 | European Pat. Off. . |
| 2379881 | 9/1978 | France . |

*Primary Examiner*—Noah P. Kamen

*Attorney, Agent, or Firm*—Robert R. Schroeder

[57] ABSTRACT

An intermediate heat transport system is disclosed for providing steam generation from the secondary non-radioactive liquid sodium heat extraction loop from a sodium cooled nuclear reactor. The transport system includes a unitary module combining the steam generating heat exchanger, the pump for the circulation of the liquid sodium coolant, and the surge volume required for differential expansion between the sodium and the vessels that contain the sodium. Two concentric cylindrical and vertically standing vessels are provided for containing the liquid sodium; one vessel is outer and larger; the other inner vessel is of a double wall construction and open on its lower end hung from the top of the longer vessel. The outer and larger cylindrical vessel has four feedwater inlet plenums (typical number) at the bottom and four steam outlet plenums at the top. Tube sheets terminate each plenum to a tube bundle extending between the inlet and outlet plenums. At least one electromagnetic high temperature sodium pump is placed within the inner vessel and hermetically sealed for pumping sodium to and from the reactor, this pump acting in the preferred capacity as the jet of a jet pump for pumping the sodium.

4 Claims, 5 Drawing Sheets

COMPACT INTERMEDIATE HEAT TRANSPORT SYSTEM FOR SODIUM COOLED REACTOR

This invention is a continuation-in-part of Application Serial No. 07/117,609 filed Nov. 6, 1987, now abandoned.

BACKGROUND OF THE INVENTION

Sodium cooled reactors are known. An example of such a sodium cooled reactor is disclosed in Hunsbedt U.S. Patent Application Ser. No. 051.332 filed May 19, 1987 and entitled Control of Reactor Coolant Flow Path During Reactor Decay Heat Removal now U.S. Pat. No. 4,767,594. Simply stated, this reactor requires two separate liquid sodium loops for the extraction of heat from the atomic reaction occurring within the reactor.

The first sodium loop is radioactive, and maintained at approximately the atmospheric pressure. This radioactive primary loop is driven by submerged electromagnetic (EM) pumps. Liquid sodium is pumped upwardly and centrally through the reactor core, which core is placed concentrically to a large upstanding cylindrically reactor vessel. The heated primary sodium then transports the heat of the atomic reaction to kidney shaped intermediate heat exchangers. The primary sodium downflows through the kidney shaped intermediate heat exchangers on the outside of the reactor vessel. The cooled radioactive sodium then passes downwardly to the bottom of the reactor vessel, to the inlet of the electromagnetic pumps. These pumps then pump the cool radioactive sodium upwardly and through the core of the reactor for endless repetition of the heat transfer cycle.

The secondary sodium loop is not radioactive. This loop functions to extract heat from the sodium cooled reactor and to transport that heat to the steam generation system where steam may be generated.

The sodium in this second loop, also maintained at approximate atmospheric pressure, passes outside of the reactor to the steam generator. Heat of the sodium is liberated to feedwater to generate steam. Thereafter the cooled sodium passes to a typically mechanical pump. At the pump the now cooled sodium is returned to the reactor for endless repetition of the cycle.

It will be understood that sodium and the metallic vessels which contain sodium differentially expand. Thus, the secondary sodium loops are required to have an expansion vessel. These vessels are usually placed in the vicinity of the steam generator.

Further, the secondary loop on sodium cooled reactors have heretofore had three separate units. These units have included the steam generator, the pump and the expansion tank.

It has been proposed to place heat exchangers in side-by-side relation to nuclear reactors. See Bonsel et al. U.S. Pat. No. 3,425,907. This unit includes the primary and secondary sodium loops and the heat exchange therebetween. Unlike the present invention, it is not concerned with steam generation or surge volumes.

Kube U.S. Pat. No. 3,882,933 discloses a gas cooled reactor. The reactor includes helical windings.

A heat exchanger and sodium heated steam generator is disclosed in Robin et al. U.S. Pat. No. 4,307,685. In this reactor helical coils between inner and outer vessel are utilized. Here, however, the inner vessel is utilized as a flow distributor to facilitate heat exchange. A similar scheme is utilized by Jullien U.S. Pat. No. 4,515,109 the central vessel being constructed to resist sodium water transients.

Robbin U.S. Pat. No. 4,056,439 entitled Secondary Heat Transfer Circuits for Nuclear Reaction Plant issued Nov. 1, 1977 discloses a heat exchanger having first and second concentric vessels. One vessel is exterior. The remaining vessel is interior, open at the bottom and smaller and concentric of the larger vessel.

In the interstitial volume between the outer larger vessel and the smaller, concentric inner vessel, steam generation tubes are helically wound. These steam generation tubes begin at a tube sheet immersed in the liquid sodium at the bottom of the interstitial volume between the inner and outer vessel. These same tubes end in a tube sheet immersed in the liquid sodium at the top of the interstitial volume between the inner and outer vessel.

Pumping is suggested in two formats.

First, a pump is mounted at the top of the small vessel. This pump draws a suction on the liquid sodium the entire length of the small, concentric inner vessel.

Second, pumping by an impeller mounted at the end of a long rotating shaft is also disclosed. This long rotating shaft enables the impeller to be placed within the inner concentric vessel where the pump is more efficiently located.

Unfortunately, for both pumping schemes rotating bearings immersed in liquid sodium are required. These bearings require the introduction of high pressure sodium for lubrication. Further, such bearings upon stopping and starting are subjected to high degrees of wear.

The Robin U.S. Pat. No. '439 reference also exposes the tube sheets at the steam exit ends of the steam generating coils directly to the liquid sodium. Such exposure, due to the high thermal conductivity of the liquid sodium, can subject the tube sheets at the steam exit to thermal shock when thermal transients in the sodium loop do occur. Such thermal shock can lead to loss of fluid tight seal across the sodium water boundaries and cracking of the tube sheets themselves.

Finally, Robin requires a pump motor be added to the total height of the resultant steam generator. Vertical space is consumed for the motor and its required supplemental bearings, seals, flange plates and the like.

SUMMARY OF THE INVENTION

An intermediate heat transport system is disclosed for providing steam generation from the secondary non-radioactive liquid sodium heat extraction loop from a sodium cooled nuclear reactor. The transport system includes a unitary module combining the steam generating heat exchanger, the pump for the circulation of the liquid sodium coolant, and the surge volume required for differential expansion between the sodium and the vessels that contain the sodium. Two concentric cylindrical and vertically standing vessels are provided for containing the liquid sodium; one vessel is outer and larger; the other inner vessel is of a double wall construction and open on its lower end hung from the top of the longer vessel. The outer and larger cylindrical vessel has four feedwater inlet plenums (typical number) at the bottom and four steam outlet plenums at the top. Tube sheets terminate each plenum to a tube bundle extending between the inlet and outlet plenums. The tube bundles are helically coiled in the lower two-thirds of the outer and larger vessel in the interstices between the inner and outer vessels. The tube bundles extend vertically upward parallel to the axis of the cylindrical vessels to the steam outlet plenums through the top one-third of the vessel to provide a portion of the required surge volume. The second concentric and smaller vessel is concentric within the outer cylindrical vessel and opened to the outer cylindrical vessel at the bottom. At least one electromagnetic high temperature sodium pump is placed within the inner vessel and hermetically sealed for pumping sodium to and from the reactor. Hot sodium inflows from the reactor at the top of the outer cylindrical vessel through a distributor. The hot sodium counterflows to the feedwater within the tube bundles in the interstices between the inner and outer vessels. At the bottom of the outer vessel when the sodium has given its heat to the steam generation, the sodium passes upwardly into the inlet of one or more electromagnetic pump(s) before return to the reactor. The sodium passes upwardly through the pump to a surge volume immediately overlying the pump. A second lower pressure surge volume is located at the top of the vessel external to the inner vessel. Provision is made for differential movement between the double walls to make up the inner vessel. These walls are exposed to differential temperatures resulting from inflow and outflow of sodium to accommodate required thermal excursion of the vessels relative to one another. Provision is made for the use of one electromagnetic liquid sodium pump in a jet pumping mode to produce high volume low pressure sodium flow as well as serendipitous cooling of outer surface of the pump stator.

Other Objects, Features and Advantages

An object of this invention is to provide an intermediate heat transport system contained within a single unitary module combining the required functions of steam generation, pumping of the sodium in the secondary loop and providing a surge volume for differential expansion of the sodium and metallic containment of the sodium. Accordingly, two concentric and cylindrical outer and inner upstanding vessels are provided. Hot sodium from the intermediate heat exchanger of the liquid sodium cooled reactor is received at the top of the outer larger vessel and downflows in the interstitial volume between the smaller inner and larger outer vessel. This hot sodium counterflows feedwater flowing in tube bundles. These tube bundles are helically coiled in the interstitial volume between the two vessels. The helical coils extend two-thirds the height of the cylindrical vessel between bottom feedwater inlets and upper steam outlets. In the top one-third of the vessel the tube bundles pass vertically upward to provide a portion of the required surge volume. Inlet of liquid sodium to the inner vessel occurs at the bottom of the inner vessel. Cooled sodium passes upwardly and concentrically through one or more electromagnetic pumps to the remaining required surge volume at the top of the inner vessel. Thereafter, the cooled sodium outflows to the reactor for endless repetition of the heat transfer cycle.

An advantage of the single module is that it is compact and eliminates the need for two additional sodium containing vessels (pump, and expansion tank) which increase the cost and complexity of the intermediate heat transport system. For example, the module can be placed in side-by-side relation to the reactor and simultaneously seismically isolated with the reactor.

A further advantage of the disclosed module is that it can use the same electromagnetic pumps utilized in the reactor. Spare pumps are thus interchangeable between the reactor and the module.

An advantage of the heat exchanger is that helical tube bundles are readily accommodated. These tube bundles can be varied in length and diameter to accommodate the heat transfer for steam generation as required.

An additional advantage of the disclosed design is that the helical coils can naturally form their helix around the inner vessel. At the same time, this normally vacant portion of prior art heat exchangers can accommodate the electromagnetic pump. An extremely volume efficient module design results.

An additional advantage of the vessel and heat flow cycle disclosed is that the sodium pump only sees cooled sodium. Thus, the passing cooled sodium accomplishes ready removal of eddy current losses and winding losses in the pump. These heat losses can in part be recovered as steam generated power.

A further advantage of the module is that it naturally defines the required surge volume for differential sodium and containment vessel expansion.

A further object of this invention is to disclose a heat exchanger design, which design can accommodate differential expansion between the vessels. According to this aspect of the invention, the inner vessel is sealed with respect to the out vessel at a bellows seal. Upon excursion of the inner vessel with respect to the outer vessel can easily be accommodated. Moreover by providing inflow and outflow of sodium in concentric pipes apertures through the vessel wall are likewise adapted for differential expansion.

An advantages of the double wall construction of the inner vessel is that it enables thermal insulation of the cold leg of the sodium passing upwardly of the inner vessel from the hot leg of the sodium passing downwardly in the interstitial volume between the inner and outer vessel. This insulation — not completely unlike that occurring in a Dewar flask— enables thermal isolation of the hot and cold legs of sodium. This insulation is particularly important where liquid sodium pumps are utilized. Such pumps in order to operate within required thermal limits must be confined to the cold legs of sodium loops—and cannot tolerate the heat of the hot legs of sodium loops.

An additional advantage of the disclosed design is the placement of the upper tube sheets terminating the steam generating tubes within an inert gas blanket. This placement avoids the sodium loop with its high thermal conductivity from subjecting the delicate tube sheets to thermal shock upon transients in the temperature of the circulating sodium. As the liquid sodium is not in contact with the upper tube sheet, and only the inert gas directly contacts the upper tube sheet, heat transfer thermal transients are avoided.

An additional object of this invention is to simplify the immerse pump array utilized for the circulation of the secondary sodium into and out of the disclosed steam generator unit. According to this aspect of the invention, a large single electromagnetic pump is located centrally of the inner concentric vessel. This large, single electromagnetic pump provides a relatively low volume, high pressure flow to the nozzle of a jet pump used to entrain a high volume, low pressure flow. This jet pump feature enables a more efficient use of the high head capability of the electromagnetic pump while providing high volume, low pressure liquid sodium flow in the secondary sodium loop.

An advantage of the large, single and central immersed sodium pump is that diameter of the entire unit is reduced. By way of example, the diameter of the central vessel can be reduced by more than one-half from over 8½ feet to 4 feet. Correspondingly, the outer diameter of the disclosed heat exchanger can likewise be reduced from 15 feet to 12 feet. A more cylindrically compact unit results.

A further and serendipitous advantage of this large single jet pump is that required cooling of the electromagnetic pump, especially at the exterior surface of the stator is easily accommodated. Flow of pumped sodium through the center of the pump cools the interior of the stator. At the same time, flow of the entrained sodium making entrance to the jet pump over the exterior of the pump stator provides required cooling to the exterior of the pump stator. An improved and cooled operating environment for the immersed liquid sodium pump results.

BRIEF DESCRIPTION OF THE DRAWINGS

Other objects, features, and advantages of this invention will become more apparent after referring to the following drawings in which.

DETAILED DESCRIPTION OF THE DRAWINGS

Figure 1:
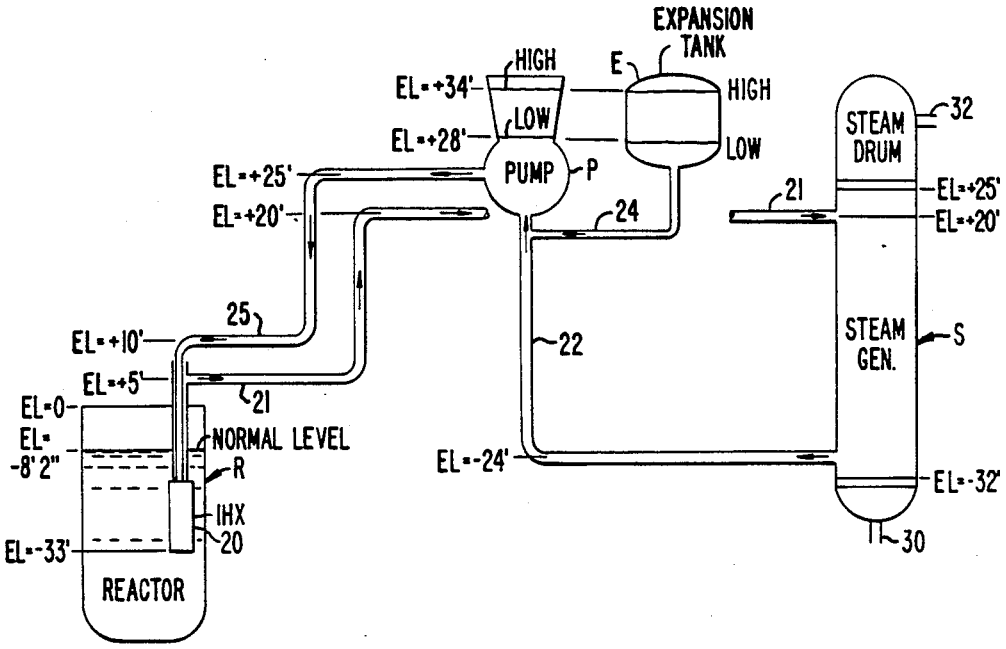
FIG. 1. PRIOR ART
FIG. 1 is a schematic view of a prior art steam generator pump and expansion tank system.

Referring to FIG. 1 the prior art is schematically illustrated. A sodium reactor R is shown with an intermediate heat exchanger 20. The reader will understand that the primary and radioactive sodium loop is entirely contained within reactor R. If the subject invention were coupled to a loop type reactor system, the reactor R would be replaced by an intermediate heat exchanger. Since this invention is concerned with the secondary and nonradioactive loop, only that loop will be described in detail.

Reactor R includes an intermediate heat exchanger 20. Heat exchanger 20 outflows hot sodium through line 21 to a steam generator S. Steam generator S generates steam internally thereof through a generally counterflow heat exchange. Feedwater enters the generator at line 30 and steam outflows the generator at line 32. Cooled sodium with heat extracted exits the generator at line 22 and passes to pump P. Line 22 and pump P are communicated by a conduit 24 to an expansion tank E. Expansion tank E rides the line with liquid sodium maintaining the required sodium level so that pump at all times sees sodium. Thereafter, the cooled sodium is reintroduced to the intermediate heat exchanger 20 in the reactor R along line 25.

Looking at the disclosure of FIG. 1, it can therefore be seen that three separate standing modules are utilized. The first is a steam generator S. The second is the expansion tank E and the third is the pump P.

Figure 2:
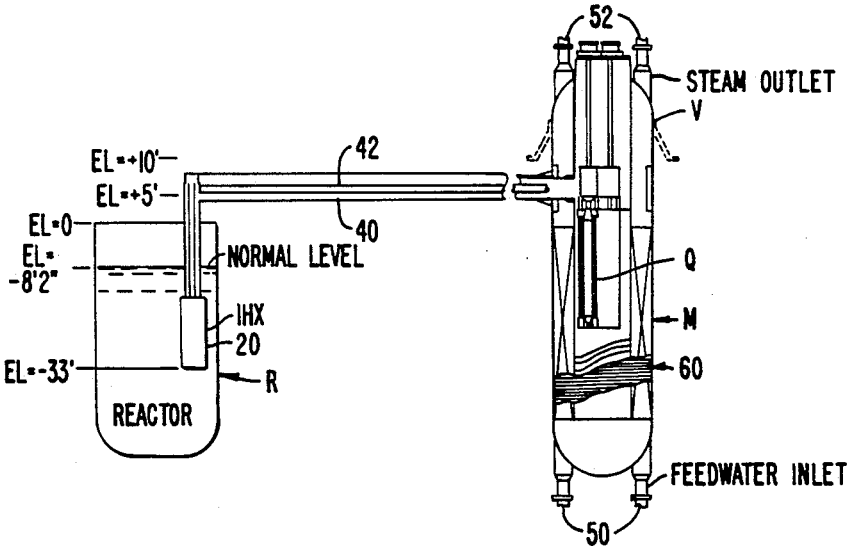
FIG. 2 is a schematic diagram of the invention herein adjacent a sodium pool reactor.

Referring to FIG. 2, the reactor R is shown connected by concentric lines 40, 42 to the improved intermediate heat transfer system module M. Feedwater flows into inlets 50 and comes out as saturated or superheated steam at outlets 52. Steam generation occurs in helical coils 60 which helical coils extend through the lower two-thirds of the module M. Required surge volumes V overlie the liquid sodium. Steam generation is counterflow with hot sodium passing from line 40 downwardly in opposing flow to upwardly passing feedwater. Thereafter, pumps Q pump the sodium upwardly and through concentric line 42 where it passes to and through the intermediate heat exchanger 20 in reactor R.

Figure 3A:
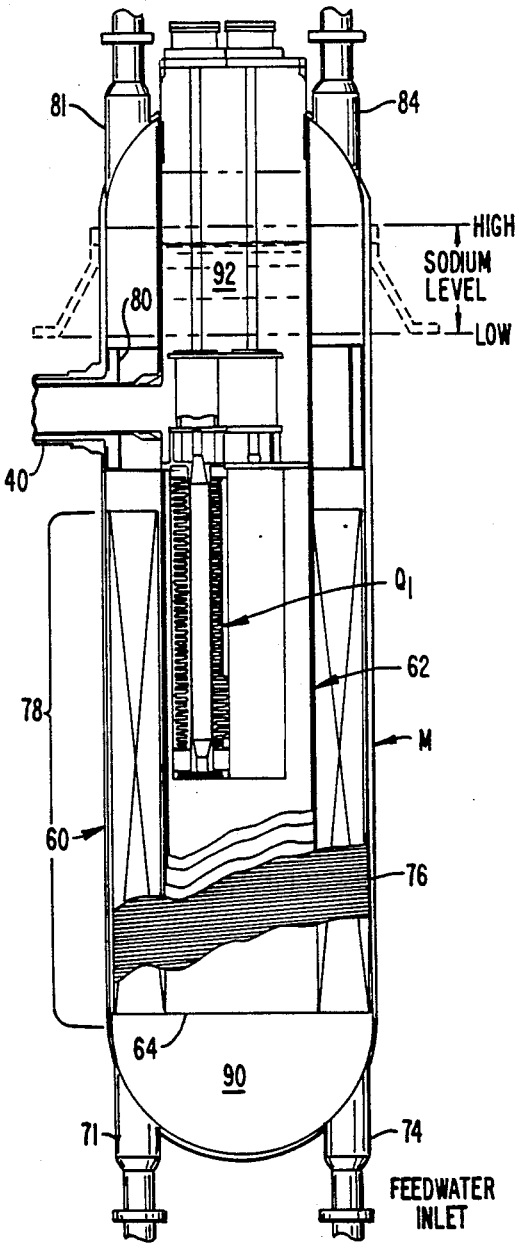
FIG. 3A is a side elevation section of the modular intermediate heat exchanger.
Figure 3B:
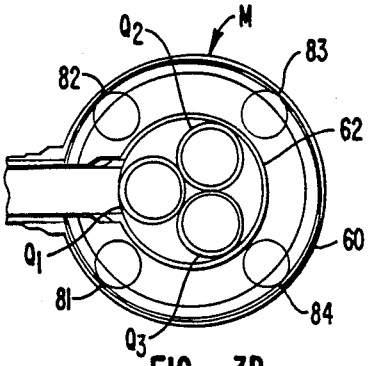
FIG. 3B is a plan view along the lines 3A—3A of FIG. 3A.

Having summarized the invention, the module M can be discussed in detail with respect to FIGS. 3A and 3B.

Referring to FIGS. 3A and 3B, the module consists of two concentric and cylindrical vessels. The first of these vessels is an outer larger vessel 60. The second of these vessels is an inner smaller vessel 62 which stands within outer larger vessel 60. Inner vessel 62 is concentric to outer vessel 60 and is hung from outer vessel 60 at the upper interface in the upper head of the outer vessel.

Figure 3C:
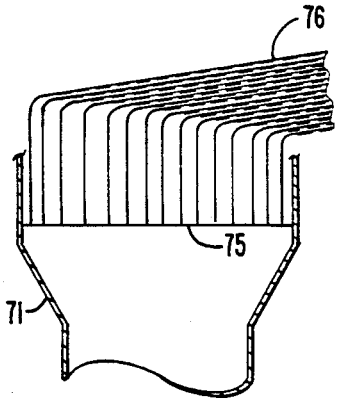
FIG. 3C is a detail of a typical tube sheet plenum for the inflow of feedwater or the outflow of steam.

Referring to FIG. 3C, feedwater is inlet to the vessel at one or more feedwater inlet plenums 71, 74. Typically, there are four such plenums. Each plenum terminates in a tube sheet 75 having approximately 150 tubes connected thereto. The tubes communicate to a tube helix 76. Helix 76 extends over the lower two-thirds of annular interstitial volume 78 defined at interstices between the inner vessel 62 and the outer vessel 60. From annular interstitial volume 78, the tube bundles extend directly vertically upward to steam tube sheet plenums 81, 82, 83 and 84 (see FIG. 3B) over the upper one-third of the cylindrical interstitial volume.

As will hereinafter be more apparent, the module is a counterflow heat exchanger. Hot sodium flows downwardly. Feedwater to be generated into steam flows upwardly. The feedwater is inlet at feedwater tube sheet plenums 71, 74 and outlet at upper plenums 81, 82, 83 and 84. The reader will understand that only two such lower plenums are shown. In actual fact, there are four feedwater inlet plenums. (See FIG. 3B.)

The sodium flow path can now be set forth.

Referring to FIG. 3A, hot sodium flows in through an outer concentric conduit 40. The sodium enters a distribution baffle 80. Baffle 80 extends around the inside of an outer vessel 60 and distributes the sodium evenly around the side walls of the outer cylindrical vessel into the interstices defined between the outer and inner cylindrical vessels.

The sodium thereafter passes downwardly. It passes downwardly in the interstitial volume between outer vessel 60 and inner vessel 62. In such passage heat is lost.

Heat is lost to the counterflowing feedwater. Specifically, and in the helical portion of the windings 76, heat is extracted from the hot sodium by the generation of steam.

After passing down between the sidewalls of the outer and inner cylindrical vessels 60, 62, the sodium enters a plenum 90. At plenum 90, the sodium reverses its path and passes centrally upward of inner vessel 62.

In the interior of vessel 62, sodium encounters an electromagnetic pump Q. In actual practice, one or more such pumps. Q1, Q2, and Q3, can be utilized.

Such pumps are known. Specifically, and by having fluctuating magnetic currents in their stator windings, electromotive force interior of the pump forces sodium centrally upward through the pump.

Sodium passes upwardly to the inner higher pressure surge volume 92 defined upwardly above the upper level of the pumps. This surge volume is within inner cylindrical vessel 62 above the pumps Q. This surge volume is in addition to that surge volume in the interstitial volume above the level of the liquid sodium present.

It should be noted that before passage through the pump the sodium is cooled. Therefore, both eddy current loses in the sodium and cooling of the windings from the pump can occur in the passing cooled sodium. This heat energy is at least one-third recovered in the ensuing steam cycle.

Having set forth the general construction of the reactor, two important details of construction can now be discussed.

Figure 4A:
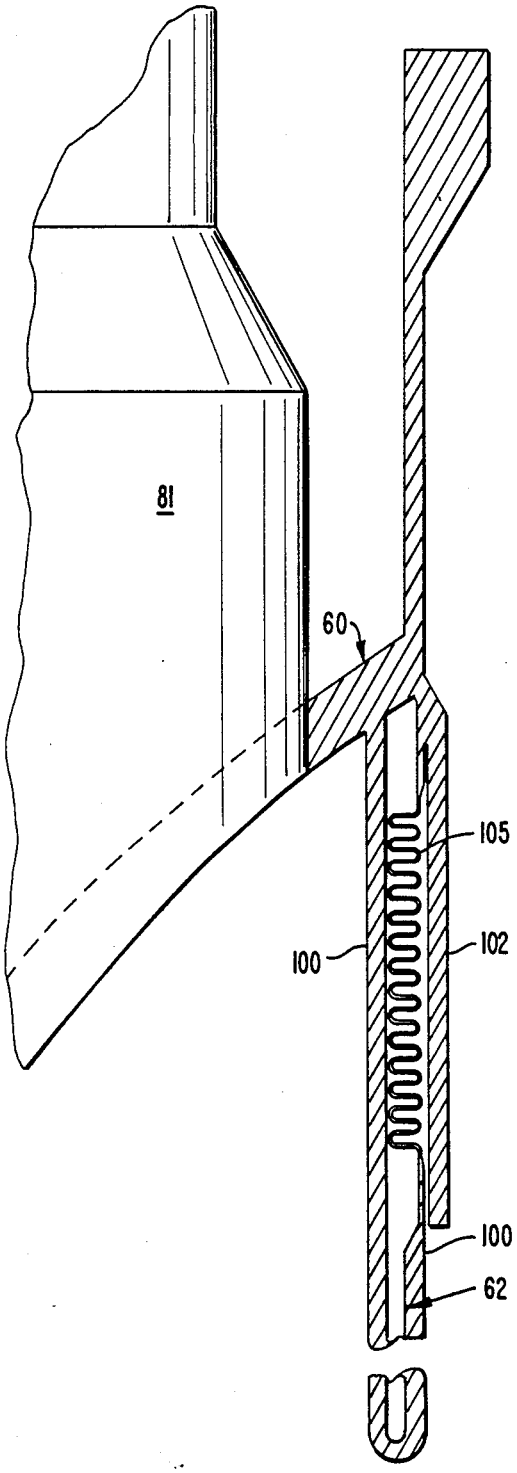
FIG. 4A is a detail of a bellows expansion joint at top portion of the module in the interstices between the inner and outer concentric vessels.

Referring to FIG. 4A, the expansion of inner cylindrical vessel 62 relative to outer cylindrical vessel 60 is illustrated. Inner cylindrical vessel 60 includes a first depending outer cylindrical shroud 100 and a second depending concentric inner cylindrical shroud 102. Shrouds 100 and 102 are circular and concentric in plan extending around the top portion of the vessel.

The upper wall of the inner cylinder at 100 makes excursion into and out of the interstitial space defined between depending concentric cylindrical shrouds 100, 102. In such excursion, an expansion bellows 105 expands and contracts. Bellows 105 fastens to wall 100 of inner vessel 62 at the bottom and to shroud 102 on outer vessel 60 at the top. Thus, the construction herein illustrated inherently provides for relative movement of the cold or inner vessel relative to the hotter outer vessel while maintaining the required sodium separation and an efficient thermal barrier which can be filled with stagnant hermetically sealed inert gas.

Figure 4B:
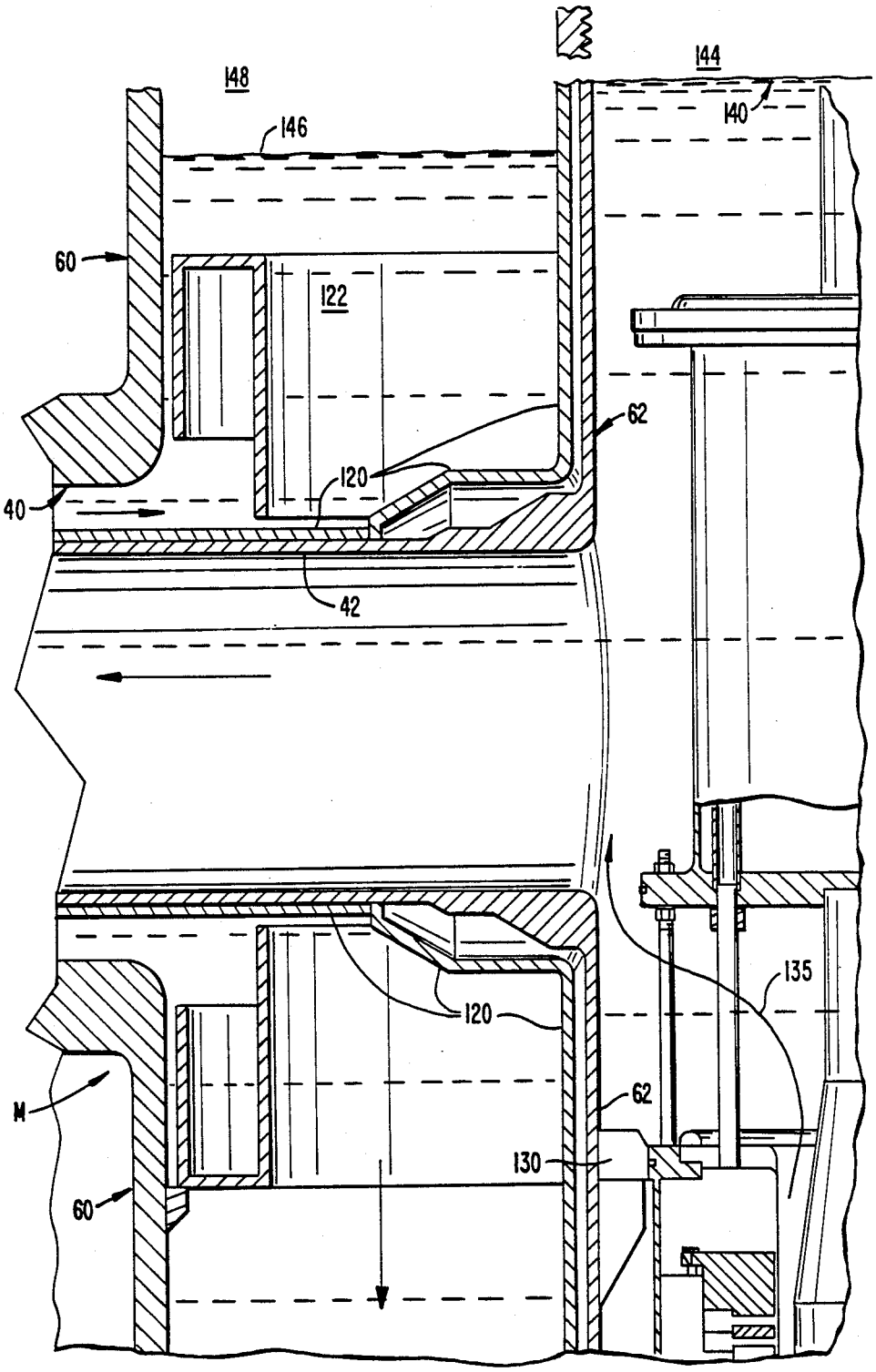
FIG. 4B illustrates a detail illustrating the inflow and outflow concentric pipes and their respective connections to the inner and outer vessels.

Referring to FIG. 4B, a detail of the module M is illustrated in the vicinity of the concentric sodium inflow conduit 40 and surrounded concentric outflow conduit 42. Typically, conduit 42 is covered by an insulating layer 120. The insulating layer functions to prevent heat loss from the hot sodium inflowing in conduit 40 to the cooled sodium outflowing in conduit 42. Hot sodium inflowing at conduit 40 flows into a baffle 122. Baffle 122 passes around the interior of vessel 60 and distributes the hot sodium along side the wall of the outer and larger cylindrical vessel 60. Thereafter, the sodium downflows in the interstitial area between the outer cylindrical vessel 60 and the inner cylindrical vessel 62. It will be appreciated that the concentric pipe arrangement of conduits 40, 42 again provides for differential expansion allowing excursion between the two vessels. Further, the concentric pipe arrangement allows simplified entrance and exits apertures through the outer vessel 60 and the inner vessel 62.

A typical detail is illustrated for the support of one of the electromagnetic pumps. The pump includes location relative to an annular ring 130 with the pump unit hung from the top of the inner vessel 62. It will be realized that inner vessel 62 in turn is supported from the top of outer vessel 64. The pump discharges sodium upwardly in the direction of arrow 135.

The reader will appreciate that level 140 will vary interior of vessel 62 to a level above a level 146 in the interstices between vessel 60 and inner vessel 62. In both cases, an inert gas plenum 144 in the case of inner vessel 62 and 148 in the case of the outer vessel 60 is provided so that differential expansion can be accommodated.

The reader will appreciate that the combined heat exchanger unit disclosed constitute a substantial advance over the prior art.

Referring to the design illustrated in FIG. 3A, two important differences of this invention over the prior art can be stressed.

First, it will be remembered that the tube sheets are contained within columns 81, 84. As contained within these columns 81, 84, the tube sheets are maintained well above the level of sodium at 146. This gives the disclosed steam generator an improved chance of avoiding thermal shock of the steam discharge tube face.

This phenomenon can be easily understood.

It can be expected that during the life of the sodium cooled reactor (not shown) that thermal transients will occur in the circulating sodium. For example, where the reactor is brought rapidly off line one might expect a rapid drop in the temperature of the circulating sodium.

Tube sheets appear at two locations. Tube sheets will be arrayed at water inlets 71–74 (see FIG. 3A and the schematic of FIG. 3C). Alternately, the tube sheets for the steam discharge side will be within the columns 81–84.

It will be remembered that the heat exchange herein is counterflow. That is to say, heated sodium flows through inlet conduit 40 downwardly in the interstitial volume between the inner cylinder 62 and the outer cylinder 60.

The flow of feedwater is counter to the flow of sodium. Specifically the feedwater flows from inlet 71–74 to outlets 81–84.

It will be understood that the heated portion of the sodium will see the upper portion of the tubes spiraling between the feedwater inlets 71–74 and the steam outlets 81–84. Consequently, thermal shock will be more apparent at the upper portion of the tube sheets.

As can be seen from FIG. 3A, tube sheets in the columns 81–84 are located well above the high level of the sodium. Tube sheets within column 81–84 will not be in contact with liquid sodium; the tube sheets will be in contact with the inert gas. This being the case, the tube sheets will be exposed to inert gas and not to the sodium.

Sodium has a very high thermal conductivity. That is to say, its ability to transfer heat is superior. It is especially high when compared to inert gases.

By maintaining the tube sheet and the delicate inner connection between the tubes and tube sheet in the inert gas portion of the upper level of the disclosed heat exchanger, the possibility of thermal shocking of the tube sheet connection is avoided.

Remembering that the disclosed heat exchanger is a counter flow heat exchanger, it will be understood that temperatures adjacent the tube sheets in feedwater inlet 71–74 will be more or less equalized. This being the case, the lower tube sheets will be subjected to a lesser degree of thermal shock. Their removal from direct contact with the sodium for the avoidance of thermal shock is not required.

Additionally, and referring to FIG. 4B, it will be understood that the construction of the inner vessel 62 relative to the outer vessel 60 imparts a uniquely useful insulation. Referring briefly to FIG. 3A, it will be remembered that the interstitial volume between the outer vessel 60 and the inner vessel 62 isolates the hot leg of the sodium. This sodium passes downwardly and into inlet 64 at the lower part of the heat exchange unit.

Beginning at inlet 64, the so-called "cold" leg of the secondary sodium loop commences.

Electromagnetic pumps Q1 are more particularly described in Olich et al. U.S. patent application Ser. No. 203,179 filed June 7, 1988 entitled Submersible Sodium Pump. These pumps require for their operating environment residence in the cold legs of sodium loops. This residence in the cold legs is required because such pumps must reject their resistance heating to the sodium they are immersed in. In order for this heat to be properly dissipated, a temperature differential must be maintained between the submersible sodium pump on one hand and the passing liquid sodium on the other hand.

It is important that this temperature differential exist in two places.

First, the temperature differential exists with respect to the pumped and passing sodium interior of the pump.

Second, this temperature differential must also exist with respect to the exterior of the pump. This exterior includes the stator of such pumps on the exterior surface.

It can be seen with reference to FIG. 4B, that a Dewar type cylinder is formed within inner vessel 62. Specifically, and referring to FIG. 4B at walls 120, it will be seen that the walls are spatially separated at a gap between the inside wall 120 of the larger exterior vessel 60 and the outside wall of the interior vessel 62. This construction continues down and to the entrance defined at the lower end of the inside vessel 62 (see FIG. 4A).

Thus, it can be seen that the sodium in which the pumps Q1–Q3 are immersed in the cold leg of the reactor is thermally insulated from the sodium of the hot leg.

It will be further understood that the suspension of the pumps Q1–Q3 uniquely cooperates in the mechanical design of this unit.

Specifically, inner vessel 62 is supported on the top of outer vessel 60.

At the same time, pumps Q1–Q3 are dependingly supported at the top of the inner vessel. Any reactive forces caused by pumps Q1–Q3 in pumping liquid sodium upwardly reacts against the depending support of the pumps.

Figure 5A:
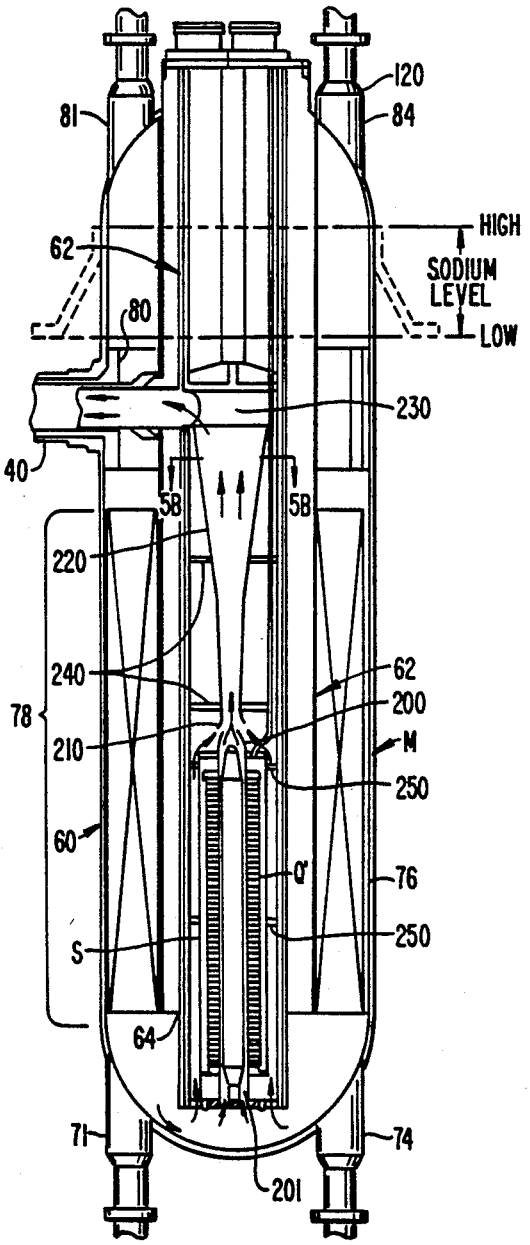
FIG. 5A is a side elevation section of the modular intermediate heat exchanger, the heat exchanger here being shown with a large, central single suspended immersed sodium pump, this pump outputting to a central jet pump for providing low pressure, high volume flow circulation through the steam generation unit; and, FIG. 5B is a plan section along lines 5B—5B of FIG. 5A illustrating a section of the pump at the jet pump diffuser.
Figure 5B:
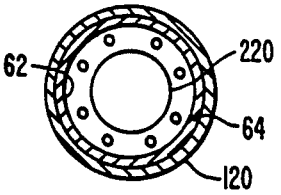

Having set forth these unique features, attention can be directed to the now preferred embodiment of the invention set forth in FIGS. 5A and 5B.

In order to understand the utility of this aspect of the invention, analysis of exemplary sodium flow rates passing through the heat exchange unit can be helpful.

In the heat exchanger illustrated in FIG. 5A, a total flow rate of 42,000 gallons per minute (gpm) is achieved. This flow rate, however, only requires a relatively low head in the range of 30 pounds per square inch (psi).

Electromagnetic pumps of the type described in Olich et al. United States Patent Application Ser. No. 203,179 filed June 7, 1988 and entitled Submersible Sodium Pump most efficiently operate at discharge rates of 10.500 gpm and heads in the order of 230 psi. As will be seen, the use of such a pump in a jet pumping capacity utilizes the head of an immersed sodium pump more efficiently and has the serendipitous advantage of providing improved cooling to the pump.

Referring to FIG. 5A, an immersed sodium pump Q′ is illustrated. Pump Q′ has a discharge 200 and an intake 201.

The pump itself suspends from the top of an inner vessel 62. This mounting occurs along a Dewar type tube having a wall 120 dividing the inside of the outer vessel 60 from the periphery of the inner vessel 62.

The outflow of electromagnetic pump Q′ is utilized as a jet. This jet passes into the venturi 210.

A single jet is here shown. The reader will understand that the single pump here illustrated could have multiple output jets as well.

It can be seen that venturi 210 opens to the exterior of the stator S of the jet pump. Consequently, sodium in the cold leg of the heat exchanger rises exterior of the stator in a continuing flow. This sodium is then entrained into the jet pump venturi 210. The sodium then passes through the jet pump diffuser 220 and discharged to a discharge plenum 230.

Assuming that pump Q′ pumps 10,500 gpm of sodium at a developed head of 230 psi, total flow through the jet pump and diffuser will be in the range of 42.000 gpm at a developed head of 30 psi. Thus, total flow through the jet pump will exceed by a factor of about 4 the total flow through the electromagnetic pump Q′.

This aspect of the invention provides two serendipitous advantages to the disclosed construction.

First, the diameter of the inner vessel 62 can be vastly reduced. In the embodiment of FIG. 3A, the diameter of the inner vessel was in the order of 8 feet, 7 inches. With the elimination of two of the three electromagnetic pumps, the total diameter of the inner vessel 62 can be reduced to 48 inches (4 feet). Thus, the dimension required for the steam generator is vastly reduced. By way of example, the total diameter of the outer vessel 60 can be reduced from 15 feet to 12 feet. This results in a substantial reduction in both size and cost of the modular heat exchange unit.

Further, the sodium flowing exterior of the electromagnetic pump improves the required cooling of the stator S of the pump Q′.

Referring briefly to FIG. 3A, it will be understood that sodium immersing the pumps is largely static. Thus, the exterior of the stator of pumps Q1–Q4 will not be cooled as efficiently as the single pump Q′ shown in FIG. 5A. As set forth in FIG. 5A, a continuous flow over the exterior surface of the stator S will result in the jet pump modification of FIG. 5A.

It will be understood that the suspension of pump Q′ has been altered. Specifically, supports 240 for support of the jet pump and 250 for support of the pump Q′ are utilized at intermittent intervals to assure concentric and stable support of the pump.

What is claimed is:

1. In combination with a sodium cooled reactor having an intermediate heat exchanger for extracting heat in a nonradioactive secondary sodium loop from said sodium reactor, the combination including:

first and second upstanding closed cylindrical vessels, one of said cylindrical vessels being exterior of the other of said cylindrical vessels;

the other of said cylindrical vessels being interior, smaller, and concentric of said larger cylindrical vessel so as to define between the inside of said larger vessel and the outside of said smaller vessel an interstitial annular volume;

at least one feedwater inlet plenums at the bottom of said larger vessel communicated to said interstitial annular volume;

at least one feedwater outlet plenums at the top of said larger and outer vessel communicated to said interstitial annular volume;

a plurality of tubes communicated to said feedwater inlet plenum at the bottom of said vessels and to the steam outlet plenum at the top of said vessel to permit feedwater flowing into said feedwater inlet plenum to be generated to steam outflowing from said steam outlet plenum, said water being generated into steam in said tubes;

a first conduit connected to said sodium cooled reactor at one end communicated through said larger vessel to said cylindrical interstitial volume at the top thereof for receiving hot sodium from said reactor and permitting hot sodium flowing through said first conduit downwardly in counterflow to water in said tubes to generate steam;

said inner vessel opening to said outer vessel at the bottom thereof whereby sodium cooled by said tubes can enter said bottom vessel;

a large single submersible electromagnetic pump disposed centrally of said inner vessel, said pump for moving liquid sodium from bottom of said vessel upwardly interior of said vessel;

a jet pump having an inlet, a venturi and a diffusing outlet;

said submersed electromagnetic pump discharging liquid sodium to said jet pump;

said inlet of said jet pump inletting fluid from the exterior of the stator of said electromagnetic pump whereby cooled sodium is drawn over the exterior of the stator of said electromagnetic pump for cooling of said pump and into said jet pump;

a second conduit communicated to said vessel and transpiercing said outer vessel and communicated to said reactor for discharging the cooled sodium from the high pressure side of said pump to said sodium cooled reactor; and cooled sodium passing upwardly of said pump to said upper portion of said inner, smaller concentric cylindrical vessel and then through said conduit to said reactor.

2. The invention of claim 1 and wherein said tubes are helically coiled at the bottom of said intersititial volume between said first larger vessel and said second smaller vessel.

3. The invention of claim 1 and wherein said first and second conduits are concentric.

4. The invention of claim 1 and wherein said inner vessel is supported from the top of said outer vessel and said inner vessel includes separate inner and outer walls, said separate and outer walls spatially separated to provide a thermal isolation of the cold sodium leg in the interior of said inner vessel from the hot sodium leg in the interstitial volume between the outside of said inner vessel and the inside of said outer vessel.

* * * * *